US005691687A

United States Patent [19]

Kumagai et al.

[11] Patent Number: 5,691,687

[45] Date of Patent: Nov. 25, 1997

[54] CONTACTLESS MAGNETIC SLIP RING

[75] Inventors: Hiroyuki Kumagai, Boulder Creek; Joe D. Deardon, San Jose, both of Calif.

[73] Assignee: The United States of America as represented by the Administrator of the National Aeronautics and Space Administration, Washington, D.C.

[21] Appl. No.: 520,865

[22] Filed: Jul. 3, 1995

[51] Int. Cl.[6] ..... H01F 21/06

[52] U.S. Cl. ..... 336/120

[58] Field of Search ..... 336/119, 120, 336/122, 123, 129

[56] References Cited

U.S. PATENT DOCUMENTS

| | | | |
|---|---|---|---|
| 3,594,587 | 7/1971 | Martens et al. | 336/120 |
| 3,662,403 | 5/1972 | Hollingsworth | 346/74 M |
| 3,758,845 | 9/1973 | MacKelvie et al. | 336/120 |
| 4,286,181 | 8/1981 | Guzman et al. | 310/49 R |
| 4,404,559 | 9/1983 | Renner | 336/123 |
| 4,446,461 | 5/1984 | Selleck | 336/123 |

*Primary Examiner*—Matthew V. Nguyen

*Attorney, Agent, or Firm*—Kenneth L. Warsh; Harry Lupuloff; John G. Mannix

[57] ABSTRACT

A contactless magnetic slip ring is disclosed having a primary coil and a secondary coil. The primary and secondary coils are preferably magnetically coupled together, in a highly reliable efficient manner, by a magnetic layered core. One of the secondary and primary coils is rotatable and the contactless magnetic slip ring provides a substantially constant output.

14 Claims, 8 Drawing Sheets

CONTACTLESS MAGNETIC SLIP RING

ORIGIN OF THE INVENTION

The invention described herein was made in the performance of work under a NASA Contract and is subject to the provision of Section 305 of the National Aeronautics and Space Act of 1958, Public Law 85-568 (72 Stat. 435; 42 U.S.C. 2457).

BACKGROUND OF THE INVENTION

A. Technical Field of Field of the Invention

The invention relates to the field of transmitting electrical power from stationary to rotating equipment and, more particularly, to an inductive device that transfers electrical power between stationary and rotating equipment without having any mechanical contact between its corresponding components connected to the stationary and rotating equipment. In addition, the inductive device can also transfer electrical signals of low frequency.

B. Description of the Prior Art

In the field of transferring electrical power/signals between stationary and rotating frames each carrying a designated piece of specialized equipment, electromechanical slip rings are commonly used. Electromechanical slip rings consist of one or more rings made of conductive material, such as a copper alloy, and brushes also made of conductive materials. Either the rings or the brushes can be interconnected to the stationary frame, and the counterpart to the rotatable frame. An electrical current is fed to the ring or brush on the stationary side and the current passes through between the ring and the brushes by means of mechanical contact therebetween. Since a mechanical contact of moving surfaces is involved, a small dust particle or mechanical imperfection of the related material forming the ring or brush can cause the two surfaces to break contact momentarily. This break of contact is reflected as a break in current, which may cause noise pulses or noise levels. To somewhat overcome this noise problem, many electrical-mechanical slip rings employ multiple brushes/rings. The rationale behind such a design is that if there are many brushes-ring contacts per circuit, when one or more brushes/rings break contact, others will remain in contact to properly pass the current. However, when any one brush/ring becomes dirty, the probability of all brushes/rings losing contact is greatly increased, which may result in high noise levels, or in some cases, a momentary loss of the signal being transferred between the ring and the brush and, thus, between the rotating and stationary equipments. It is desired that a device serving as a slip ring be provided, but without the need of mechanical contact between its moving surfaces.

An inductive device that serves as a mechanical slip ring, devoid of any mechanical contact between its moving surfaces, is disclosed in U.S. Pat. No. 4,286,181 ('181) which is herein incorporated by reference. The '181 patent discloses a magnetic slip ring that cooperates with associated coils that are arranged and sequentially energized to provide for rotary and/or linear movement of a rotary device, serving as a stepping motor mechanism. The magnetic slip ring allows the shaft of the stepping motor mechanism to advance in indexing movements to serve many purposes, such as opening a pack of flexible disk storage members. However, the magnetic slip ring of the '181 patent is not a device that could be used to transmit electrical power information or data from one point or one device to another, inside or outside a system. More particularly, the '181 patent teaching a magnetic slip ring for a stepping motor mechanism, does not provide any teachings or suggestions of a device that may be used to transfer electrical power/signals between one piece of equipment that is stationary and another piece of equipment that is rotatable.

Accordingly, it is a primary object of the present invention is to provide a device serving as a magnetic slip ring which transfers electrical power between stationary and rotatable equipments without any mechanical contact between its corresponding components connected to the stationary and rotatable equipment and without suffering any possibility of losing the electrical signal being transferred.

Another object of the present invention is to provide a device that comprises inductive components arranged to yield high and reliable efficient transfer of electrical power between stationary and rotatable equipments.

It is a further object of the present invention to provide an inductive device serving as a magnetic slip ring and having a primary coil and a rotating secondary coil both of which are coupled together by a core and all of which are arranged to achieve high and reliable efficient transfer of electrical power between stationary and rotatable equipments.

Still further, it is an object of the present invention to provide a device serving as a magnetic slip ring which can also transfer electrical signals of low frequency.

SUMMARY OF THE INVENTION

The present invention is directed to an inductive device for transferring electrical power between stationary and rotatable equipment and is devoid of any mechanical contact between its corresponding rotatable and stationary components. The amount of power that can be transferred is limited only by the heat dissipation scheme thereof and the size of the device.

In one embodiment, the inductive device serves as a system for coupling AC electrical current between transmitting and receiving equipment one of which is rotatable and the other of which is stationary. The inductive device comprises a primary coil, at least one secondary coil, and means for mechanically coupling one of the primary and secondary coils to the rotatable equipment. The primary coil has a predetermined number of wrapped wires each of a predetermined wire gauge. The wrapped wires of the primary coil have first and second ends that are connected to one of said transmitting or receiving equipment. At least one secondary coil is spaced apart from the primary coil and has a predetermined number of wires each having a predetermined wire gauge. The wrapped wires of the secondary coil have first and second ends that are connected to the other of the transmitting or receiving equipment.

DETAILED DESCRIPTION OF THE INVENTION

Figure 1:
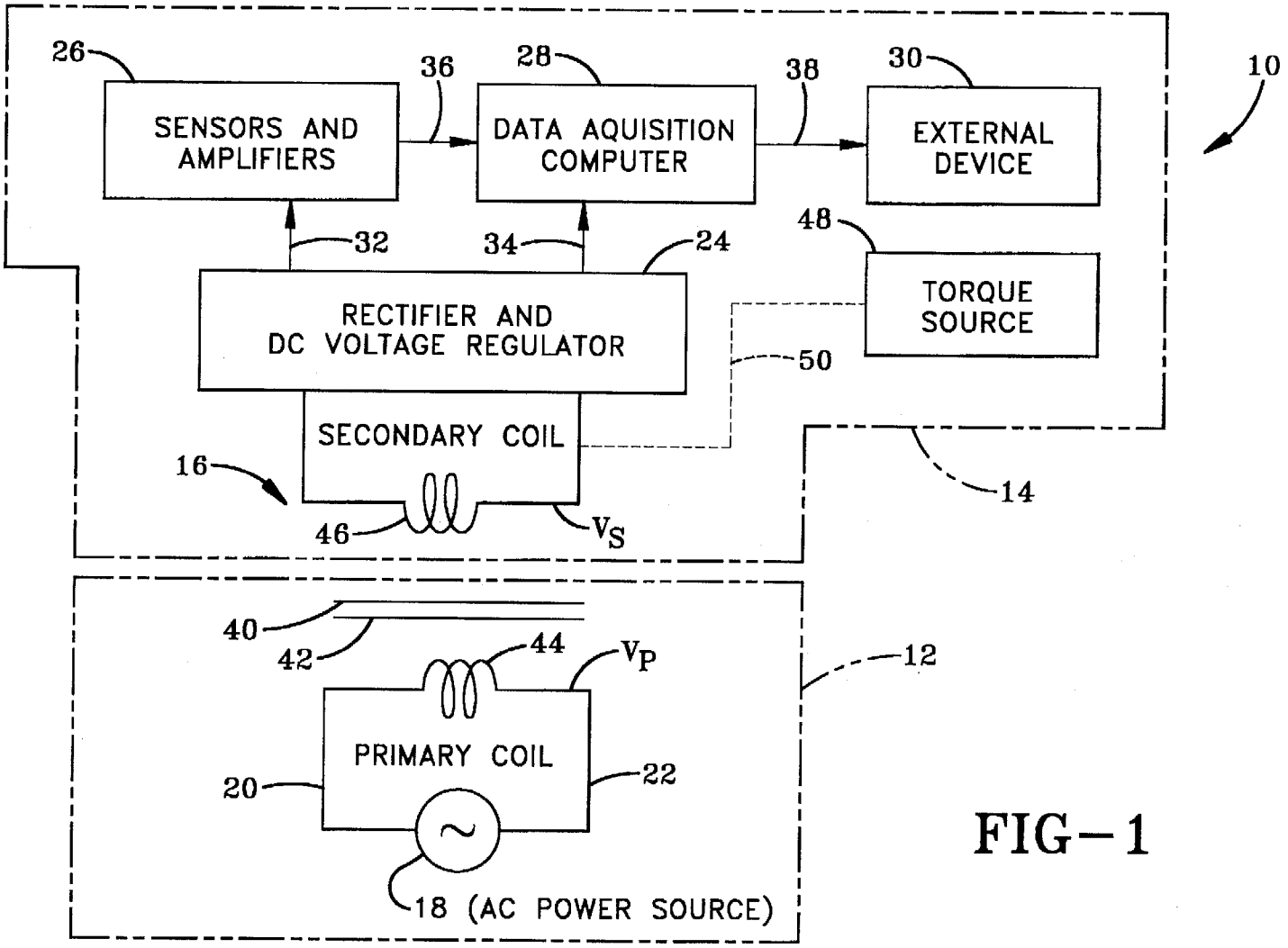
FIG. 1 is a block diagram of the system of the present invention for transferring electrical power between stationary and rotatable equipment.

Referring now to the drawings, wherein like numerals designate like elements, there is shown in FIG. 1 a system 10 for coupling A.C. electrical power between transmitting equipment 12 and receiving equipment 14, one of which is rotatable and the other of which is stationary. For the embodiment shown in FIG. 1, the transmitting equipment 12 is stationary, whereas the receiving equipment 14 is rotatable. The electrical power coupling is provided by an inductive energy transfer device 16, herein referred to as a "magnetic slip ring." Even though the magnetic slip ring 16 transfers energy between stationary transmitting equipment 12 and rotatable receiving equipment 14, unlike conventional slip rings, the magnetic slip ring 16 of the present invention is devoid of any mechanical contact between its components that are connected to the stationary and rotating equipments 12 and 14, respectively. The contactless magnetic slip ring 16 of the present invention does not suffer the drawbacks of conventional slip rings burdened with moving surfaces, discussed in the "Background" section, that are subjected to dirt and arcing conditions which might cause relatively high noise levels to be encountered or even momentary loss of the electrical signals that are being transferred between the stationary and rotatable equipments.

The transmitting power equipment 12 comprises an A.C. power source 18 having a typical value of 110 volts at a frequency of 60 Hz. However, it should be recognized that various other voltages, such as 220 volts at a frequency of 400 Hz, may be used in the practice of this invention. As will be apparent hereinafter, the obtainment of the 110 volts AC at 60 Hz, or other voltages, is primarily dependent upon the parameters of the wrapped wire of the magnetic slip ring 16. The magnetic slip ring 16 receives its input signal or voltage $V_P$ on signal lines 20 and 22.

The receiving equipment 14 may comprise a rectifier and DC voltage regulator 24, sensors and amplifiers 26, a data acquisition computer 28 and an external device 30 all arranged as shown in FIG. 1. The rectifier and DC voltage regulator 24, sensors and amplifiers 26, and the data acquisition computer 28 are all conventional, whereas the external device 30 may be selected for a particular application and provided with particularly desired data by the data acquisition computer 28. The rectifier and DC voltage regulator 24 provides power and excitation voltage to the sensors and amplifiers 26 by way of path 32 and power, such as DC power, to the data acquisition computer 28 by way of path 34. The sensors and amplifiers 26 provide sensed data to the data acquisition computer 28 by way of path 36 which, in turn, provides related computed data (which in one embodiment may be a stream of infrared data) to the external device 30 by way of path 38.

The magnetic slip ring 16 comprises inner and outer cores 40 and 42 respectively (to be further described) symbolically shown, a primary coil 44, and a secondary coil 46 which carries an output signal, indicated as $V_S$. The secondary coil 46 may further comprise another coil provided by means of a tap (not shown) in a manner well known in the art. The secondary coil 46 may be rotatable in response to a torque source 48 having means 50 for mechanically coupling to the secondary coil 46. For the embodiment of FIG. 1, the torque source 48 is shown as part of the receiving equipment 14, but for other embodiments in which the transmitting equipment 12 is rotatable, the torque source 48 may be part of the transmitting equipment 12. For the sake of clarity, the hereinafter given description for the magnetic slip ring 16 only describes the parameters and operation of a single secondary coil 46, but it should be understood that such a description is also applicable to multiple secondary coils contemplated by the practice of the present invention. A second embodiment of the magnetic slip ring 16 used as a data transmitter may be further described with reference to FIG. 2.

Figure 2:
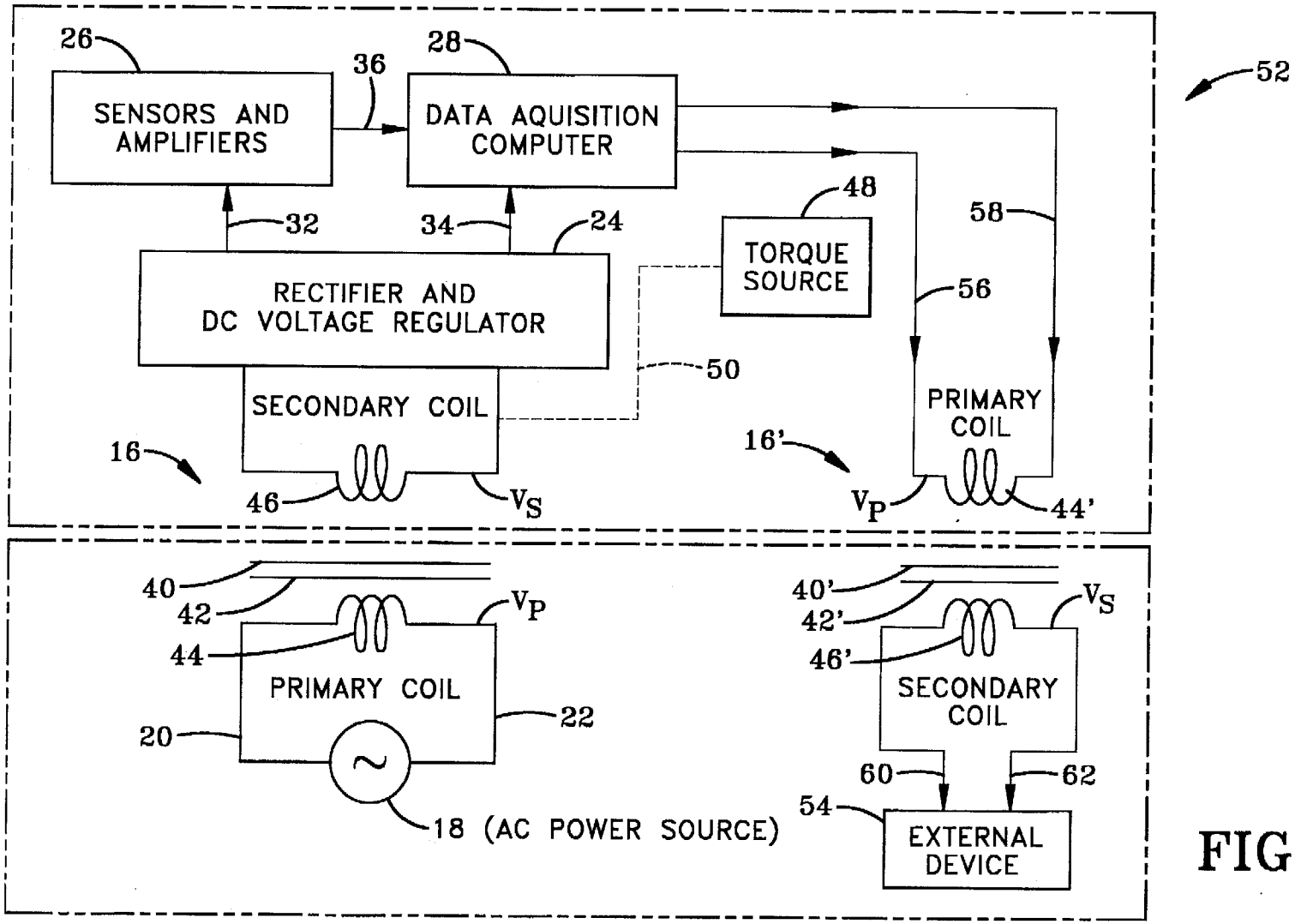
FIG. 2 is a block diagram of the present invention for transferring data between stationary and rotatable equipment.

FIG. 2 illustrates an arrangement 52 having many of the features of arrangement 10 of FIG. 1, but in addition thereto, has a second magnetic slip ring indicated as 16' and an external device 54 which replaced the external device 30 of FIG. 1. The magnetic slip ring 16' is comprised of the same elements as magnetic slip ring 16 and the elements are indicated as such by the use of the prime (') symbol.

The magnetic slip ring 16' is interposed between the data acquisition computer 28 and the external device 54 and provides for data transfer therebetween. It is preferred that the data be of a low frequency, such as 30 Hz. The data output of the data acquisition computer 28 is routed, by way of signal paths 56 and 58, to the magnetic slip ring 16'. More particularly, for the embodiment shown in FIG. 2, the magnetic slip 16' is arranged in a conventional manner so that the primary coil 44' receives the arriving data and transfers the data to the secondary coil 46', but if desired the secondary coil 46' may be arranged to receive the arriving data and transfers the data to the primary coil 44'. For the embodiment shown in FIG. 2, the magnetic slip ring 16' transfers the data to the external device 54 by way of secondary coil 46' and signal paths 60 and 62.

In general, the magnetic slip ring 16 acts similar to a common transformer in that it employs electromagnetic induction to transfer electrical energy from one circuit, via its primary coil, to another, via its secondary coil, and does so without direct connection between circuits. If desired, the transfer of energy may be arranged so as to occur from the secondary coil to the primary coil. However, unlike the common transformer, the magnetic slip ring 16 comprises at least one secondary coil, or at least one primary coil, that is rotatable. Further, unlike the common transformer, the primary and secondary coils are structurally decoupled from each other. Further details of the magnetic slip ring 16 may be further described with reference to FIG. 3.

Figure 3:
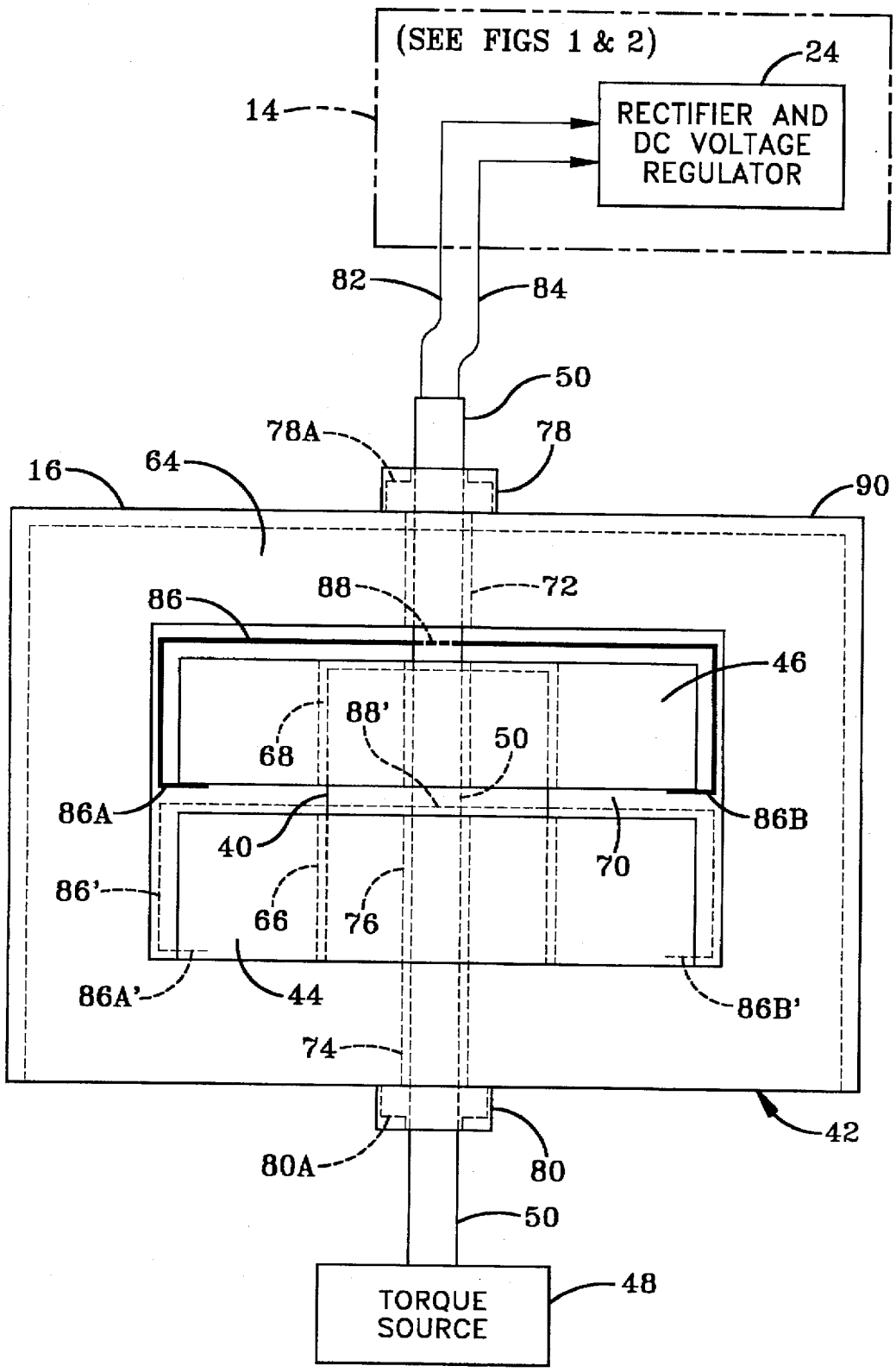
FIG. 3 illustrates the details of one embodiment of a magnetic slip ring of the present invention.

The outer core 42, for the embodiment shown in FIG. 3, of the magnetic slip ring 16 comprises layers of sheets of magnetic metal preferably comprising silicon steel and has a peripheral portion 64. The inner core 40 has a length and a diameter both dimensioned so as to be inserted into openings 66 and 68 of the primary and secondary coils 44 and 46, respectively, which are separated from each other by a distance 70. In actuality, the inner core 40 and the outer core 42 are a one-piece arrangement with the inner core 40 forming a central extension of the outer core 42. The peripheral portion 64 of the outer core 42 has a central opening 72 in its upper region and a central opening 74 in its lower region. The peripheral portion 64, in its entirety, encompasses a portion of each of the primary and secondary coils 44 and 46. The inner core 40 has opening 76 which is concentric with openings 72 and 74 of the peripheral portion 64 of the outer core 42.

As seen in FIG. 3, the means 50 for mechanical coupling is insertable into and passes through the openings 72 and 74 of the outer core 42 as well as through the opening 76 of the inner core 40. The openings 72, 74, and 76 are primarily provided because of the physical placement of the torque source 48 and its means 50 for mechanically coupling. More particularly, for the embodiment of FIG. 3, the torque source 48 is located below the magnetic slip ring 16 so that the openings 72, 74, and 76 are provided to allow the means 50 for mechanically coupling to be extended upward and into the magnetic slip ring 16.

The means 50 for mechanical coupling comprises, in part, a tubular member preferably formed of a stainless steel material and having a hollow extending therethrough and bearings 78 and 80 at opposite ends thereof. The hollow of the tubular member 50 serves as a conduit for routing the wires 82 and 84 from appropriate connections on secondary coil 46 to the rectifier and D.C. voltage rectifier 24 of FIGS. 1 and 2. Similarly, although not shown, the magnetic slip ring 16' of FIG. 2 is provided with appropriate connections to its rotating primary 44' or secondary 46' coil. The bearings 78 and 80 form the means on which the tubular member 50 journals and comprises steel balls 78A and BOA, respectively, that roll easily and serve as a means for reducing frictional rotation of the tubular member 50.

For the embodiment shown in FIG. 3 using a solid representation, the tubular member 50 is connected to the secondary coil 46 by clamping means 86 which in one embodiment comprises a bar. The bar 86 has opposite ends 86A and 86B that are dimensioned to snugly engage and rigidly capture the lower circumferential edges of the secondary coil 46. The bar 86 further comprises a central portion 88 that snugly passes through an opening (not shown) of the tubular member 50. For the embodiment shown in FIG. 3 using a phantom representation, the tubular member 50 is connected to the primary coil 44 by clamping means 86' having central portion 88' and opposite end 86'A and 86'B all of which elements respectively correspond and are similar to elements 86, 88, 86A and 86B shown in solid. Further parameters of the magnetic slip ring 16 enclosed in casing 90, preferably comprising non-ferrous material, may be described with reference to FIG. 4 which is a top view of the embodiment illustrated in FIG. 3.

Figure 4:
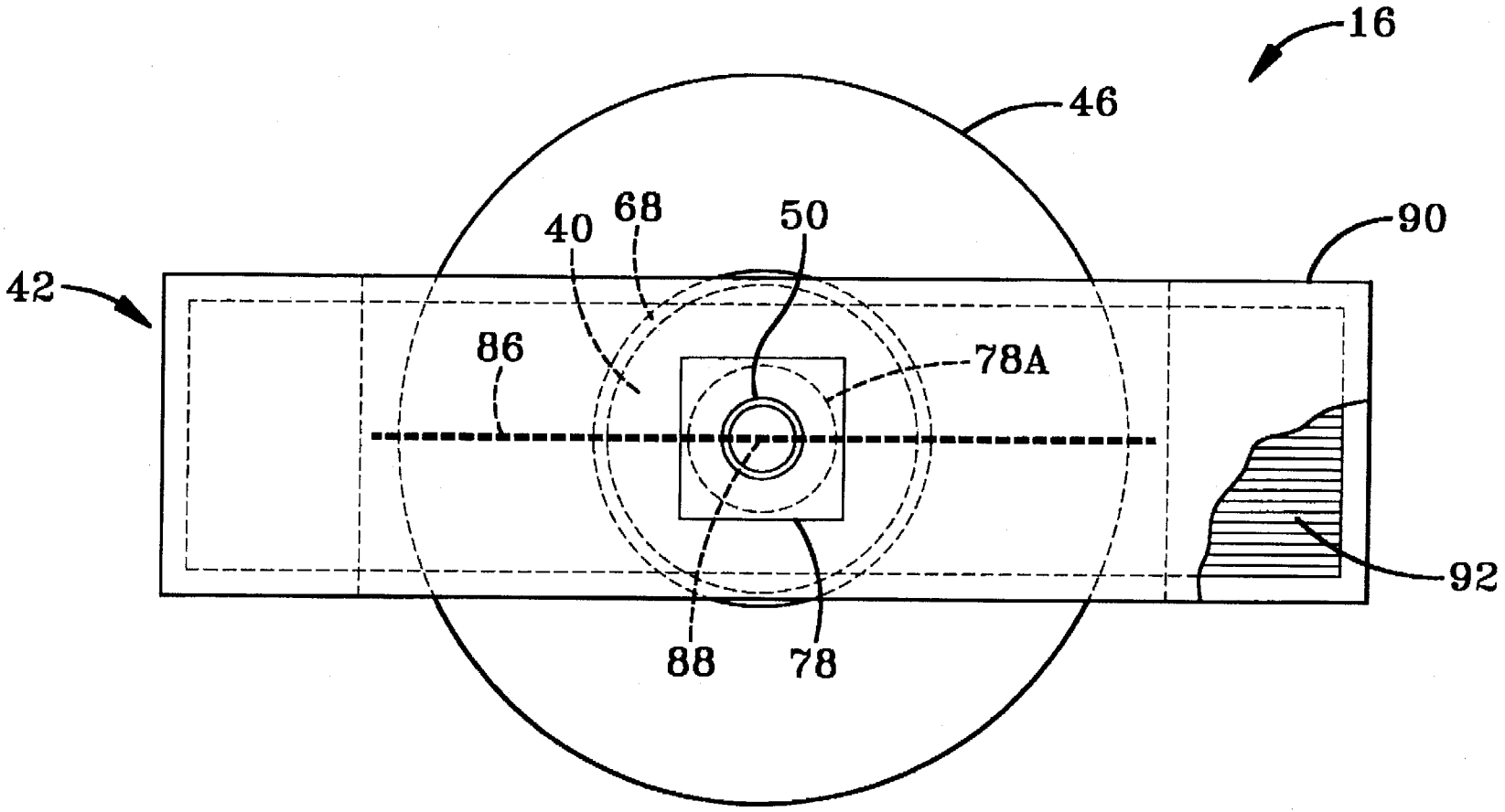
FIG. 4 is a top view of the magnetic slip ring of FIG. 2.

FIG. 4 is partially cut away so as to illustrate that the outer core 42 comprises a plurality of layers of sheets 92 of the magnetic silicon steel. As seen in FIG. 4, the secondary coil 46 preferably has a shape of a donut and similarly, although not shown, the primary coil 44 also preferably has a donut shape that is complementary to that of the secondary coil 46. Further, the inner core 40 preferably has the shape of a donut, whereas the outer core 42 preferably has a rectangular shape. The primary and secondary coils 44 and 46 may also be concentric with respect to each other and may be further described with reference to FIG. 5.

Figure 5A:
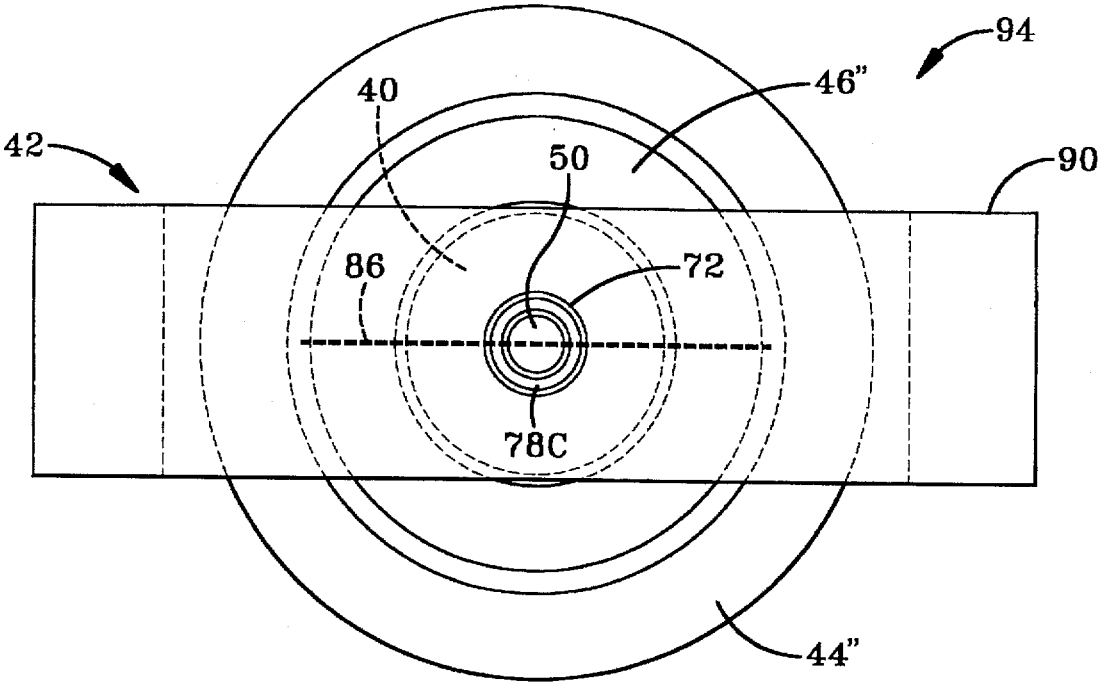
FIG. 5 is composed of FIGS. 5(A) and 5(B) that respectively illustrate a top and a side view of another embodiment of a magnetic slip ring of the present invention.
Figure 5B:
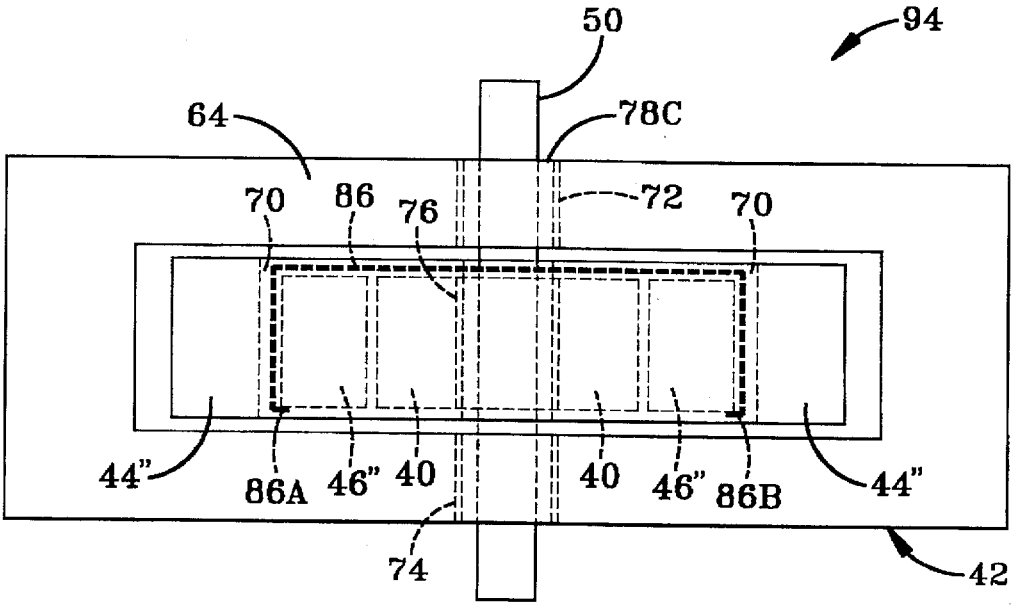

FIG. 5 is composed of FIGS. 5(A) and 5(B) that respectively illustrate a top and side view of a magnetic slip ring 94 having an inner core 40, a primary coil 44", and a rotatable secondary coil 46", wherein, as shown in FIGS. 5(A) and 5(B) the primary and secondary coils 44" and 46" are concentric with respect to each other, and the secondary coil 46" is rotatable by mechanical means 50 being rotated within a sleeve bearing 78C.

The parameters of the magnetic slip ring 16 are primarily defined by the application in which it is used, but only the size and cooling of the magnetic slip ring 16 limit the voltage, current and frequency of the power that it may transfer. In one embodiment, the primary coil 44 was formed of three hundred and seventy-three (373) turns of #20 gauge wire wrapped around a mold or carrier comprised of a magnetic material in a manner known in the art. Further, the secondary coil 46 was formed of seventy-one (71) turns of #14 gauge wire wrapped around a separate carrier also in a manner known in the art. For such selected windings, the primary coil 44 may be operated with a seventy (70) volts input voltage which causes the development of an output signal of seven (7) volts across the secondary coil 46. Further, for such a configuration, the magnetic slip ring 16 may carry 35 watts of continuous power and 50 watts of peak power.

In the practice of this invention, if the signals being transferred by the magnetic slip ring 16 do not carry sufficient amount of power, or if a relatively large power loss is acceptable, the outer core 42 and also, but less preferred, the inner core 40 may be eliminated. However, it is preferred to maintain the inner and outer cores 40 and 42 because the primary and secondary coils 44 and 46 are magnetically coupled together by the inner and outer cores 40 and 42 in an efficient manner and because the outer core 42 comprises layers 92 of silicon steel that reduce the heat and eddy current losses occurring during the transmission of AC power, such as that occurring between the transmitting and receiving equipment 12 and 14, respectively. Further embodiments of a magnetic slip ring 16 that preferably include both inner and outer cores 40 and 42 may be further described with reference to FIGS. 6–8.

Figure 6:
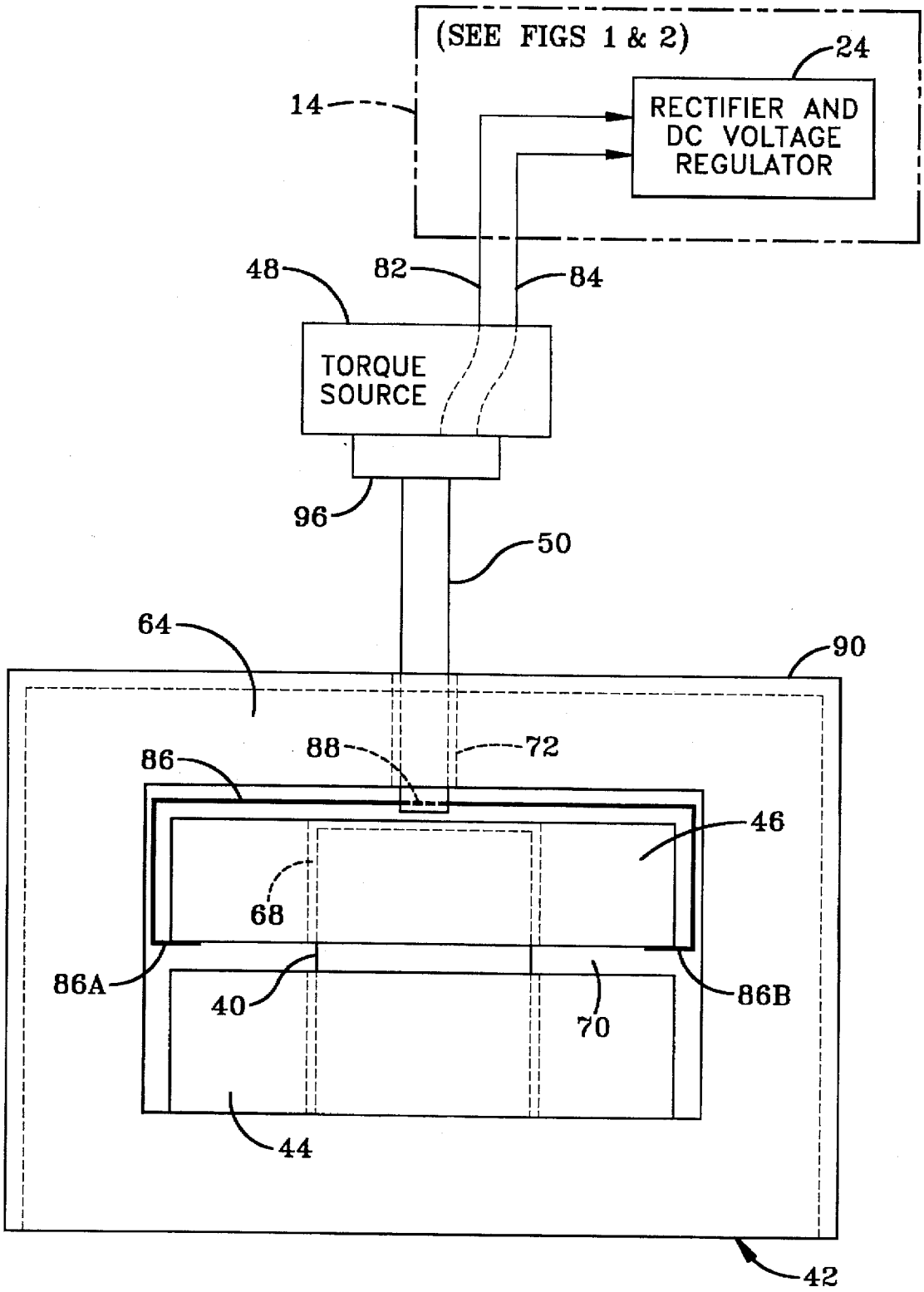
FIG. 6 illustrates an alternate embodiment of the magnetic slip ring of the present invention for accommodating a drive shaft arrangement different from that shown in FIGS. 3 and 5.

FIG. 6 is similar to FIG. 3 except that the torque source 48 is positioned above the magnetic slip ring 16 so that the tubular member 50 needs only be insertable into and extend through the opening 72 at the upper region of the peripheral portion 64 of the outer core 42. The arrangement shown in FIG. 6 has an external bearing 96 positioned at the torque source 48 and attached to the tubular member 50 which is rotatably coupled to the secondary coil 46, via the clamping means 86 in a manner previously described with reference to FIG. 3. The secondary coil 46, illustrated in FIG. 6 and also in FIGS. 3 and 4, having an opening 68 so as to allow the insertion of the inner core 40, may be provided with friction reducing means which may be described with reference to FIG. 7.

Figure 7:
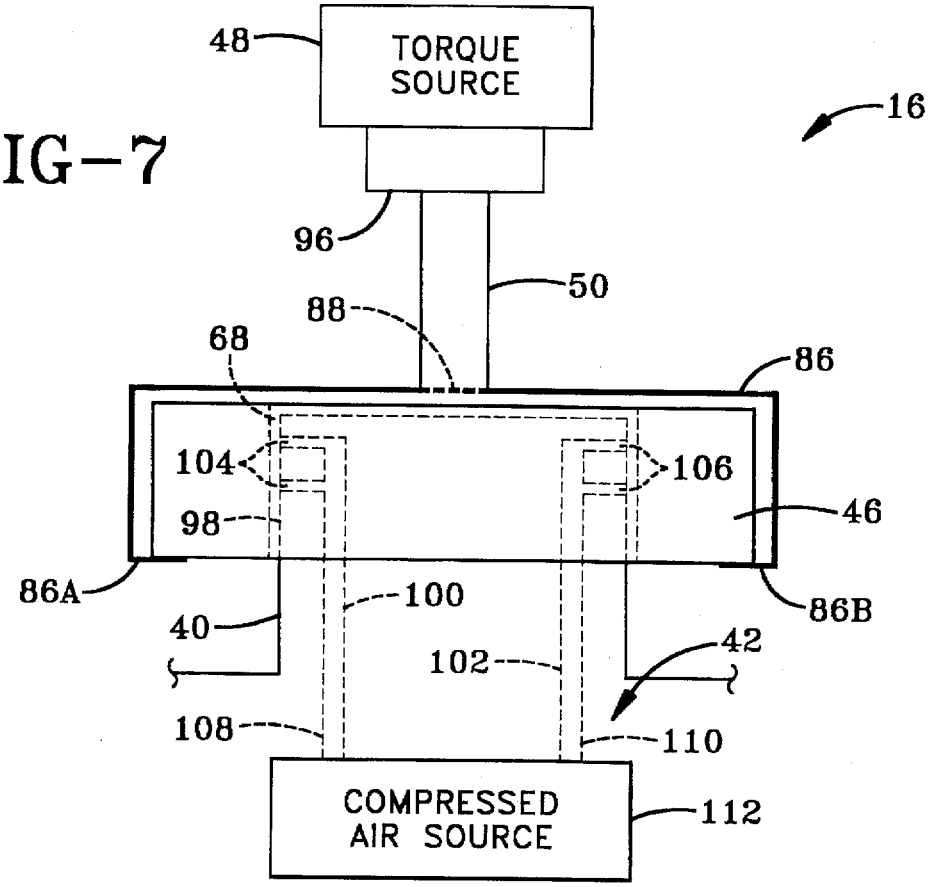
FIGS. 7 and 8 respectively illustrate alternate embodiments for providing friction reducing means between the stationary core and rotating secondary coil both of the magnetic slip ring of the present invention.

FIG. 7 is another arrangement of supporting the secondary coil 46 and illustrates the magnetic slip ring 16 with the primary coil 44 removed so as to more clearly focus on the secondary coil 46. Further, FIG. 7 illustrates a gap 98 between the inner core 40 and the central opening 68 of the secondary coil 46. The gap 98 is supplied with bearing means forming part of the torque transmission means comprising elements 48 and 50 and further comprising at least one duct or multiple ducts 100 and 102, respectively, having multiple exit portions 104 and 106, as well as respectively having entrance portions 108 and 110. The exit portions 104 and 106 are arranged to empty into the gap 98, whereas the entrance portions 108 and 110 are connected to a compressed air source 112. The compressed air source 112 supplies a fluid, i.e., air, that keeps the secondary coil 46 spaced apart from the inner core 40 at a predetermined distance in spite of the secondary coil 46 being rotated. A second bearing means for keeping the secondary coil 46 at a predetermined distance from the inner core 40 may be described with reference to FIG. 8.

Figure 8:
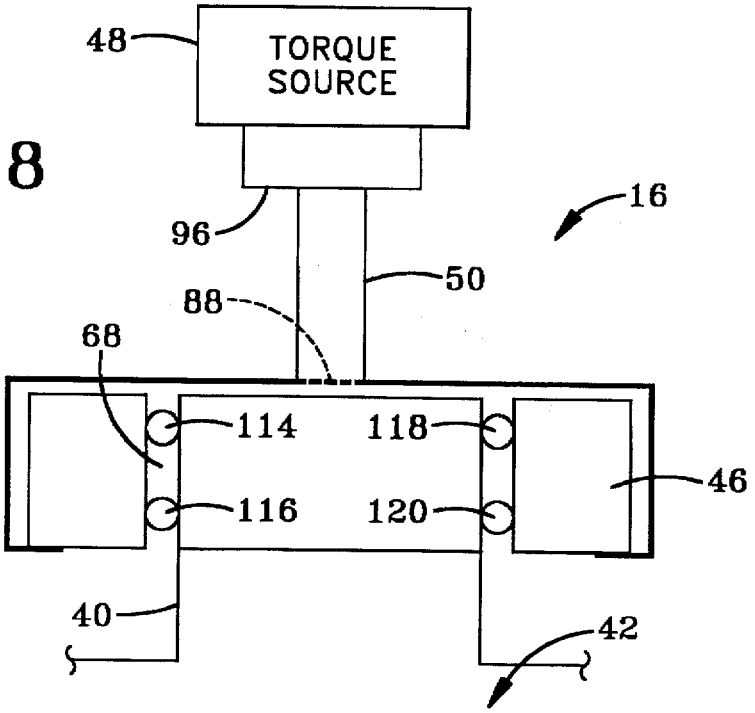

FIG. 8 illustrates an embodiment similar to that of FIG. 7 except that at least one ball or roller bearing but preferably a plurality of ball or roller bearings such as 114, 116, 118 and 120 are positioned in the gap 98 and affixed thereto by a conventional tray (not shown) having means which allow the rotation of the ball roller bearings 114, 116, 118 and 120 but the confinement of the ball roller bearings 114, 116, 118 and 120 within the gap 98.

It should now be appreciated that the practice of the present invention provides for different embodiments of a magnetic slip ring 16 having a stationary primary coil, a rotational secondary coil and preferably inner and outer cores with the inner core having a diameter which is dimensioned to be insertable into central openings in the primary and secondary coils. The inner and outer cores are preferably formed into one element. Furthermore, the magnetic slip ring may be arranged to have the primary coil serve as the rotating member and the secondary coil serve as the stationary member. The outer core is dimensioned to encompass a portion of each of the primary and secondary coils and to assist in the coupling of magnetic flux between the primary and secondary coils.

Operation of the Magnetic Slip Ring

In operation, and with reference to FIG. 1, the signal, being of an alternating current (AC) generated by the transmitting equipment 12, is applied to the primary coil 44. When the alternating current flows through the primary coil 44, the resulting magnetic flux in the inner and outer cores 40 and 42 induces an alternating current across secondary coil 46. The induced voltage causes a current to flow in an external circuit, such as the rectifier and DC voltage regulator 24. As will be further described with reference to FIG. 9, a constant power is transmitted to the rectifier and DC voltage regulator 24, even when an energized torque source 48 is connected to the secondary coil 46 via the means 50 for the mechanically coupling thereof and causing rotation of the secondary coil 46. The inner and outer cores 40 and 42 close the magnetic dipole fields associated with magnetic flux created by the application of the alternating current across the primary coil 44. This closure results in efficient coupling between the primary coil 44 and secondary coil 46 and, thus, between the stationary transmitting equipment 12 and the rotatable equipment 14.

As previously mentioned, the primary coil 44 and secondary coil 46 have their parameters (number of wrapped wires) selected so that, as known in the art, an appropriate voltage may be generated by the AC power source 18 and applied to the primary coil 44 to develop an output signal across the secondary coil 46.

Practice of the Present Invention

Figure 9:
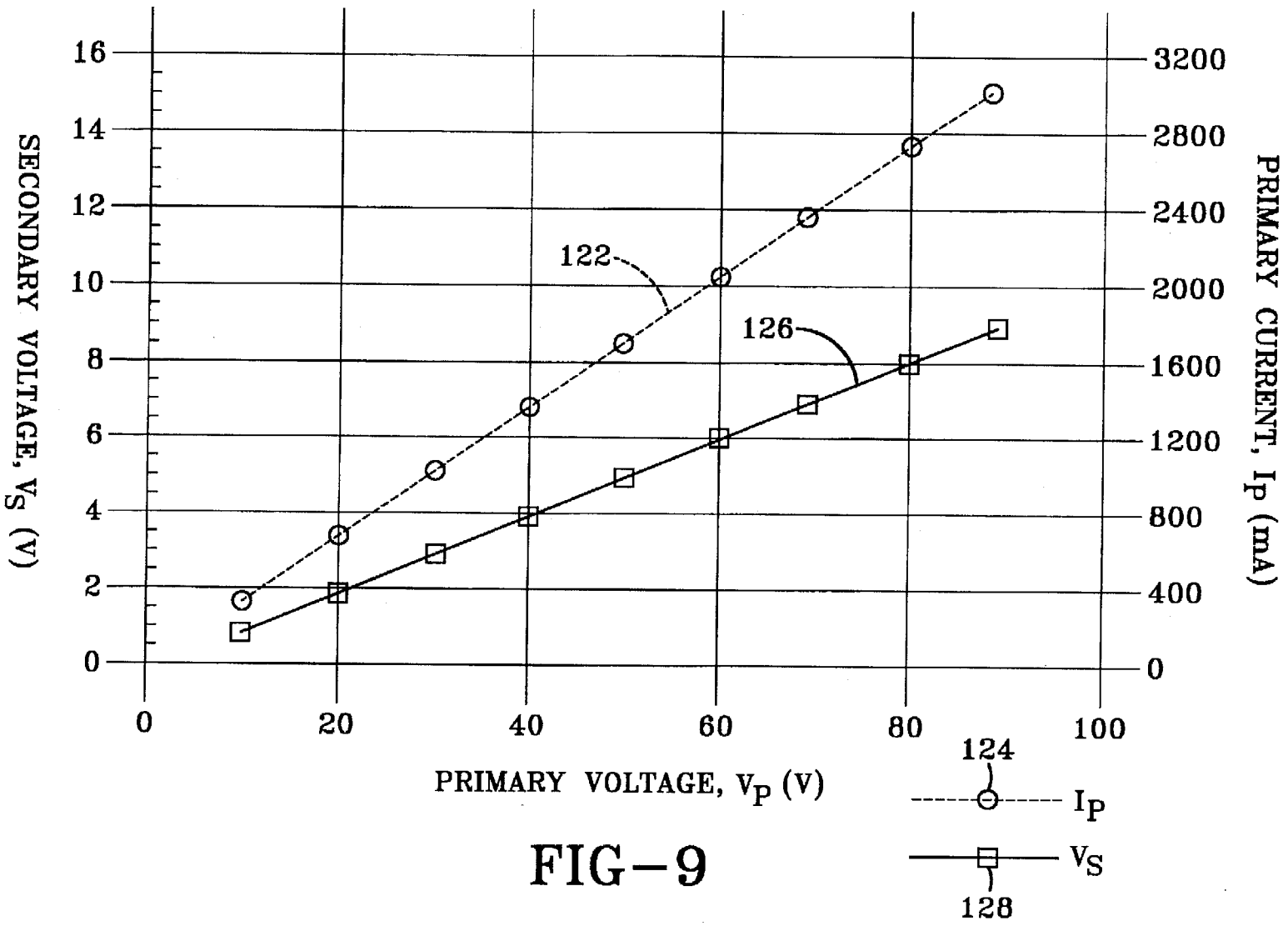
FIG. 9 illustrates the response curve of the magnetic slip ring of the present invention.

In the practice of the present invention, testing was performed and the results of which are shown in FIG. 9 which is illustrates the response characteristic of the magnetic slip ring 16. FIG. 9 has a single X axis indicating the voltage $V_P$ across the primary coil 44, and two Y axes, one of which is for the secondary voltage $V_S$ across the secondary coil 46 and the other of which is for the primary current $I_P$ across the primary coil 44.

FIG. 9 has a plot 122 designated with the symbol coding 124 which indicates the response of the $I_P$ current across the primary coil 44, and a plot 126 designated with the symbol coding 128 which indicates the response of the secondary voltage $V_S$ across the secondary coil 46. A review of plots 122 and 126 reveals that the magnetic slip ring 16 has linear response characteristics particularly suited for transferring power between stationary and rotatable equipment.

It should now be appreciated that the practice of the present invention provides for a magnetic slip ring 16 that is devoid of any contact between its stationary and rotatable components. Because of the non-contact feature, the magnetic slip ring 16 does not suffer from noise encountered by conventional slip rings. Further, because the magnetic slip ring is an inductive device, unlike conventional slip rings, it requires low or no maintenance at all, since there is no electro-mechanical contacts to be periodically cleaned. Moreover, the operation of magnetic slip ring 16 provides power transfer that is completely unchanged regardless of the rotation status of its secondary coil. In addition, the magnetic slip ring because of its inductive components has the capability to be sized to meet the physical requirements of various applications. Furthermore, because of its inductive operation, unlike conventional slip rings it does not have any tendency to generate sparks so that it can be operated even when combustible gases are present. Unlike conventional electro-mechanical slip rings, the magnetic slip ring of the present invention does not rely on insulation provided by air, therefore, it can be operated in vacuum or at a high altitude without any special consideration.

Although only limited embodiments have been illustrated and described, it is anticipated that various changes and modifications will be apparent to those skilled in the art, and that such changes may be made without departing from the scope of the instant invention as defined by the appended claims.

What we claim is:

1. A system for coupling electrical signals and power between transmitting and receiving equipment one of which is rotatable and the other of which is stationary, said system comprising:

(a) a primary coil having a predetermined number of wrapped wires each of a predetermined wire gauge, said wrapped wires having first and second ends that are connected to one of said transmitting and receiving equipment;

(b) at least one secondary coil spaced apart for said primary coil and having a predetermined number of wrapped wires each of a predetermined wire gauge, said wrapped wires having first and second ends that are connected to the other of said transmitting and receiving equipment, said primary and secondary coils each having an opening which is concentric with each other;

(c) means for mechanically coupling one of said primary and secondary coils to the rotatable equipment;

(d) inner and outer cores with the outer core comprising layers of sheets of magnetic metal and the inner core having a diameter which is dimensioned to be and is inserted into each of said opening of said primary and secondary coils and yet to be spaced apart from each of said primary and secondary coils, said outer core being dimensioned to encompass a portion of each of said primary and secondary coils.

2. The system according to claim 1, wherein said primary and secondary coils are dimensioned to be concentric to each other with one being placed inside the other.

3. A magnetic slip ring comprising:

(a) a primary coil having a predetermined number of wrapped wires each of a predetermined wire gauge, said wrapped wires having first and second ends that are capable of being connected to one stationary and rotatable equipment;

(b) at least one secondary coil spaced apart for said primary coil and having a predetermined number of wrapped wires each of a predetermined wire gauge, said wrapped wires having first and second ends that are connected to the other of said stationary and rotatable equipment, said primary and secondary coils each having an opening which is concentric with each other;

(c) means for mechanically coupling one of said primary and secondary coils to the rotatable equipment; and (d) inner and outer cores with the outer core comprising layers of sheets of magnetic metal and the inner core having a diameter which is dimensioned to be and is inserted into each of said opening of said primary and secondary coils and yet to be spaced apart from each of said primary and secondary coils, said outer core being dimensioned to encompass a portion of each of said primary and secondary coils.

4. A magnetic slip ring comprising:

a) a primary coil having a predetermined number of wrapped wires each of a predetermined wire gauge, said wrapped wires having first and second ends that are capable of being connected to one stationary and rotatable equipment;

(b) at least one secondary coil spaced apart for said primary coil and having a predetermined number of wrapped wires each of a predetermined wire gauge, said wrapped wires having first and second ends that are connected to the other of said stationary and rotatable equipment, said primary and secondary coils being dimensioned to be concentric to each other with one being placed inside the other;

(c) means for mechanically coupling one of said primary and secondary coils to the rotatable equipment; and (d) inner and outer cores with the outer core comprising layers of sheets of magnetic metal and the inner core having a diameter which is dimensioned to be and is inserted into each of said opening of said primary and secondary coils, said outer core being dimensioned to encompass a portion of each of said primary and secondary coils.

5. The magnetic slip ring according to claim 3, wherein said means for mechanically coupling comprises a bar member with end portions that are dimensioned to engage and to be rigidly affixed to opposite edges of said secondary coil, said bar means being dimensioned to snugly pass through an opening in the remainder of said means for mechanically coupling.

6. The magnetic slip ring according to claim 3, wherein said means for mechanically coupling comprises a tubular member having an axially extending hollow and bearing means at each of its ends.

7. The magnetic slip ring according to claim 6, wherein a pair of wires is respectively connected to said first and second ends of said secondary coil, said connected wires extending through said hollow of said member.

8. The magnetic slip ring according to claim 6, wherein said tubular member comprises a stainless steel material.

9. The magnetic slip ring according to claim 3, wherein the outer core comprises layers of sheets of silicon steel confined in a casing comprising a non-ferrous material.

10. The magnetic slip ring according to claim 3, wherein said secondary coil and said inner core are spaced apart from each other to form a gap therebetween, said gap accommodating torque transmission means.

11. The magnetic slip ring according to claim 10, wherein said torque transmission means comprises at least one duct having exit and entrance sections at opposite ends thereof, wherein the entrance section is coupled to a source of compressed air and the exit section is arranged to empty into said gap.

12. The magnetic slip ring according to claim 11, wherein said torque transmission means further comprises at least one ball or roller bearing rotatably mounted in said gap.

13. The magnetic slip ring according to claim 6, wherein said outer core has an upper central region having an opening and through which said tubular member extends.

14. The magnetic slip ring according to claim 3, wherein said primary coil comprises about three hundred and sixty-three (363) wrapped turns of #20 gauge wire and said secondary coil comprises about seventy-one (71) wrapped turns of #14 gauge wire.

* * * * *